United States Patent [19]

Hirose

[11] Patent Number: 4,548,145

[45] Date of Patent: Oct. 22, 1985

[54] HOLDER FOR DETACHABLY MOUNTING A PRESSER FOOT

[75] Inventor: Tomonao Hirose, Tokyo, Japan

[73] Assignee: Kohshin Seimitsu Kikai Kabushiki Gaisha, Tokyo, Japan

[21] Appl. No.: 635,127

[22] Filed: Jul. 27, 1984

[51] Int. Cl.[4] ..... D05B 29/12

[52] U.S. Cl. ..... 112/240; 112/151

[58] Field of Search ..... 112/235, 240, 151

[56] References Cited

U.S. PATENT DOCUMENTS 3,724,407 4/1973 Simon ..... 112/240
4,165,699 8/1979 Nishi ..... 112/240
4,385,576 5/1983 Marsh ..... 112/240
4,492,173 1/1985 Hirose ..... 112/240

*Primary Examiner*—Werner H. Schroeder
*Assistant Examiner*—Andrew M. Falik
*Attorney, Agent, or Firm*—Birch, Stewart, Kolasch & Birch

[57] ABSTRACT

A holder for detachably mounting a presser foot in a sewing machine. The holder consists of a holder body and a ruler rod mount. The holder has a longitudinal channel on its rear side for accommodating the ruler rod mount. This configuration is effective in allowing workers to assemble these parts easily and quickly with their fingers.

4 Claims, 4 Drawing Figures

PRIOR ART

HOLDER FOR DETACHABLY MOUNTING A PRESSER FOOT

BACKGROUND OF THE INVENTION

This invention relates to a holder for detachably holding a presser foot in a sewing machine.

Such holder is composed of a holder body and ruler rod mount integrally assembled with the holder body. Usually the ruler rod mount is made of a synthetic resin mold, and is designed to detachably fit in the rear recess of the holder body.

FIG. 4 shows a conventional cloth pusher holder as comprising a metal holder body "a" and a synthetic resin ruler rod mount 4. As shown, the holder body "a" comprises a hollow head with windows 10 on opposite sides of the head; a stem integrally connected to the head and provided with a recess "c" at the rear side of the stem, communicating with the hollow space of the head; and a lower front projection provided with a cross slit 8 and a hole 7 extending through the projection in the direction perpendicular to the cross slit. On the other hand, the ruler rod mount comprises an apertured head, a stem integrally connected with the apertured head, a lever 3 integrally connected with the stem and slanting upward, and a thin rod 6 integrally connected to the lower end of the stem and slanting downward. The apertured head has a hole, in which a ruler rod (not shown) is to be inserted and detachably held.

In assembling, the ruler rod mount is pushed in the rear recess "c" of the holder body "a" with the apertured head of the mount fitted in the hollow head of the holder body "a" and with the fine rod 6 of the mount "c" inserted in the through hole of the holder body "a". Specifically, the stem 4*a* of the mount is pushed against the ceiling of the recess by applying a force to the root of the lever 3, and then the stem 4*a* is yieldingly bent, thus causing the thin rod 6 to retire backward to allow the tip of the thin rod 6 to put itself in the through hole 7 of the holder body "a". Thereafter, the mount 4 is released, and the mount is fitted in the rear recess of the holder body with the hole 10 of the mount 4 in registration with the windows 9 of the head of the holder body "a", and with the fine rod 6 of the mount 4 passing through the hole 7 of the holder body "a". The thin rod 6 is long enough to appear across the cross slit 8 of the nose end of the front projection of the holder body "a". Thereafter, the mount 4 is rotatably fixed to the holder body "a" by inserting a pin "d" through the mount between the opposite side walls of the recess "c" of the holder body "a". When it is desired that a cloth pusher is attached to the holder "a", the lever 3 is pushed against the rear side of the holder body to withdraw the thin rod 6 from the slit 8, and then the cross rod of the presser foot is put in the slit 8 of the holder body "a". The presser foot is caught by the fine rod 6 when the lever 3 is released, thus rotatably fixing the presser-foot to the holder. When it is desired that the presser foot is released from the holder, it suffices that the lever 3 is pushed against the rear side of the holder to withdraw the thin rod 6 from the cross slit 8.

As described above, in the conventional holder the holder body "a" and the ruler rod mount 4 are integrally assembled with each other with the aid of a cross pin "d". In this connection, apertures appropriate for insertion of a cross pin "d" must be made in the opposite side walls of the recess "c" in the holder body. Also, special jigs tools are required for insertion of the cross pin in the apertures of the opposite side walls of the holder and across the thickness of the mount therebetween. Thus, the integral connection of these complimentary parts required much time and a high degree of skill.

SUMMARY OF THE INVENTION

In view of the above the object of this invention is to provide a holder for detachably holding a presser foot, permitting easy and quick assembly of a holder body and a ruler rod mount simply by fingers.

To attain this object a holder for detachably holding a presser foot according to this invention comprises: a holder body having a longitudinal recess extending the whole length of the rear side of the holder body, two windows in the upper portions of the opposite side walls, and a front projection integrally connected to the lower portions of the opposite side walls and provided with a cross slit across the nose end of the front projection and a hole extending through the hole projection perpendicular to the cross slit; and a ruler rod mount having an apertured head equipped with two opposite projections along the rear sides of the aperture of the head, a stem integrally connected to the head and extending downward, and a lever integrally hinged to the lower portion of the stem and equipped with a fine rod slanting downward. A lateral step rises from the inside surface of each side wall, and extends along the lower lateral side of each window, and the side walls are integrally connected to each other by a bridge piece. The ruler rod mount is made of a synthetic resin mold. In assembling these complimentary parts the ruler rod mount is pushed in the longitudinal recess of the holder body with the lower edges of the square head of the mount laid on the steps of the opposite side walls of the holder body and with the fine rod of the ruler rod mount inserted in the hole of the front projection of the holder body. When the ruler rod mount is pushed in the longitudinal recess of the holder body, the opposite projections or tongues along the rear sides of the apertures of the head of the ruler rod mount are yieldingly bent until they come to the windows of the opposite side walls of the holder body, and then the resilient tongues return to their original stress-free positions, thus catching the rear sides of the windows of the opposite side walls of the holder body. On the other hand, the thin rod of the ruler rod mount is inserted in the through hole of the front projection to appear across the cross slit of the nose end of the front projection of the holder body. When assembled, the lower front of the ruler rod mount is pushed against the cross bridge of the holder body to cause the tip of the thin rod to rise somewhat, thus assuring that the thin rod resiliently catches the under side of the cross rod of the presser foot. Advantageously, the presser foot holder according to this invention can be easily and quickly assembled by using the fingers.

Other objects and advantages of this invention will be understood from the following description of a preferred embodiment.

DETAILED DESCRIPTION OF THE PREFERRED EMBODIMENTS

Figure 1:
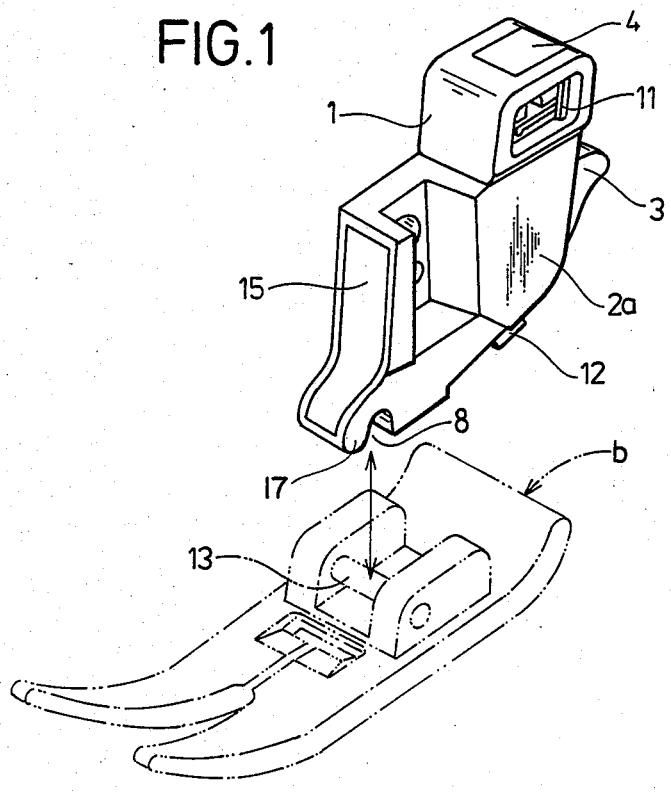
FIG. 1 is a perspective view of a holder for holding a presser foot according to one embodiment of this invention, showing a presser foot in phantom lines.
Figure 2:
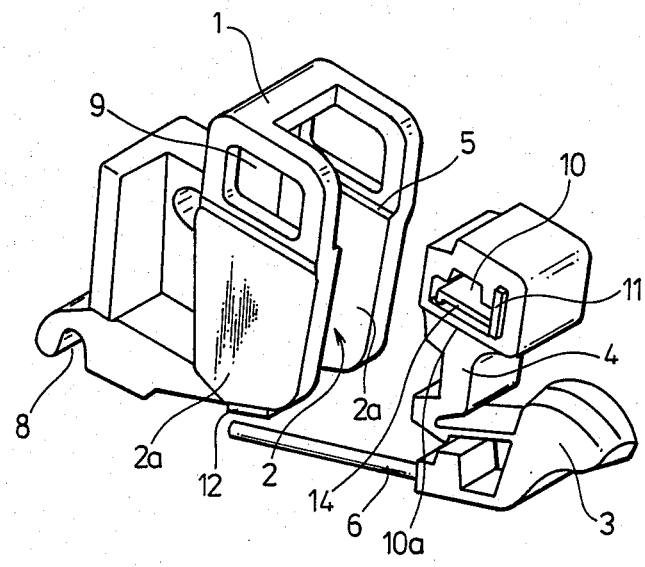
FIG. 2 is a perspective view of the presser foot holder in a disassembled position.
Figure 3:
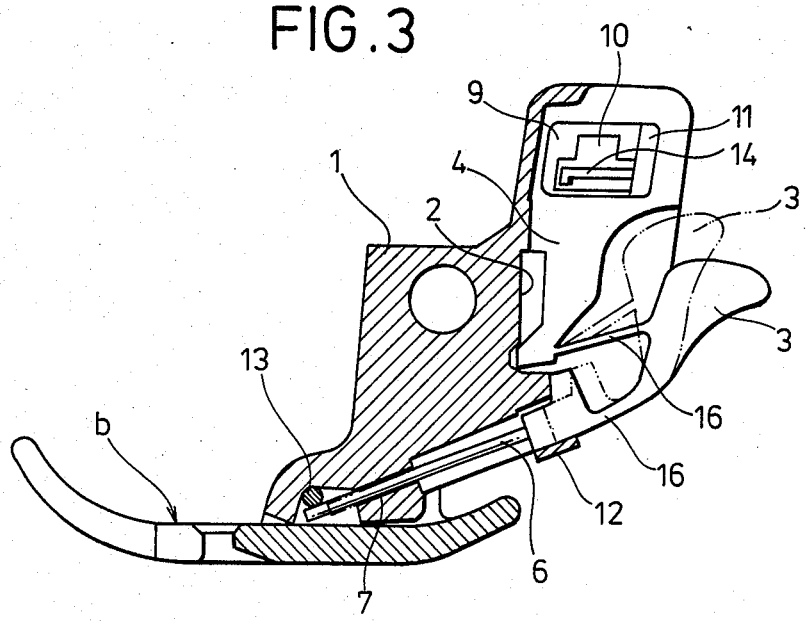
FIG. 3 is a side view of the presser foot holder, partly in section.
Figure 4:
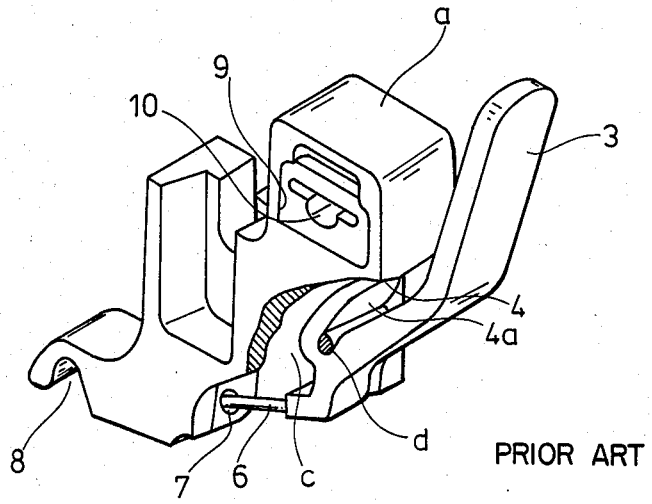
FIG. 4 is a perspective view of a conventional presser foot holder with a part broken out.

FIGS. 1 to 3 show a presser foot holder according to this invention as comprising a holder body 1 and a ruler rod mount 4. The holder body 1 has a longitudinal open-ended recess or channel 2 on the rear side thereof, two windows 9 in the upper portions of the opposite side walls 2*a* and a front projection integrally connected to the lower portions of the opposite side walls 2*a* and provided with a cross slit 8 across the nose end of the front projection and a hole 7 extending through the front projection in the direction perpendicular to the cross slit 8. As shown, a lateral step 5 rises from the inside surface of each side wall 2*a*, and the step 5 extends along the lower lateral side of each window 9. The side walls 2*a* are integrally connected to each other by a bridge piece 12. On the other hand, a ruler rod mount 4 has an apertured square head, a stem integrally connected to the square head and extending downward and a lever integrally connected to the lower portion of the stem via a hinge portion. The apertured square head has an aperture 10 appropriate for accommodating a ruler rod (not shown) and projections 11 along the rear sides of the aperture 10. The free end of the lever has a thin rod 6 slanting downward in the direction opposite to that in which the lever extends.

In assembling the holder body 1 and the ruler rod mount 4 with each other the thin rod 6 is inserted in the hole 7, and the opposite lower edges 10*a* of the apertured square head are laid on the lateral steps 5 of the opposite side walls 2*a*. The thin rod 6 of the ruler rod mount 4 is inserted in the hole of the front projection of the holder body. Then, the ruler rod mount 4 is pushed in the longitudinal recess 2 of the holder body 1 with the projections or tongues 11 yieldingly bent until these tongues 11 come to and snap in the windows 9 of the square head. The tongues 11 are released to catch the rear sides of the aperture 9 of the side walls 2*a*, and at the same time, the thin rod 6 is urged by the resilient hinge 16 to extend through the front projection of the holder body 1 so that it appears across the cross slit 8.

As shown in FIGS. 1–3, the aperture of the head of the ruler rod mount 4 has a cantilever extension 14 thereacross, thereby permitting the resilient grasp of a ruler rod (not shown) when inserted in the aperture 10. If the front 15 of the holder body 1 is painted white, the hole of a sewing needle when raised will be advantageously viewed well, thus making it easy to thread the needle.

The holder body 1 may be made of a synthetic resin which is harder than that of the ruler rod mount 4 or may be made of a molded metal.

It should be understood that this invention should not be limited to the sole embodiment as described above, and that a variety of modifications are possible without departing from the spirit of this invention.

What is claimed is:

1. A holder for detachably holding a presser foot comprising:

a holder body (1) having two opposite side walls (2*a*) defining therebetween a longitudinal recess (2) on the rear side of the holder body, each of said side walls having a window opening (9) in the upper portion thereof and a step (5) rising from the inner-surface thereof and extending along the lateral side of the window opening (9), and a front projection (17) integrally connected to the lower portions of the opposite side walls (2*a*) and provided with a cross slit (8) across the nose end of the front projection and a hole (7) extending through the front projection in the direction perpendicular to the cross slit (8); and a ruler rod mount (4) having an apertured head equipped with two opposite projections (11) along the rear sides of the aperture (10) of the head, a stem integrally connected to the head and extending downward, a hinge (16) integrally connected to the lower portion of the stem, and a lever (3) integrally connected to the hinge and having a thin rod (6) slanting downward from the free end of the lever, thus permitting the assembly of the holder body and the ruler rod mount by pushing the ruler rod mount in the longitudinal recess of the holder body with the lower lateral edges of the square head of the ruler rod mount positioned on the steps of the side walls of the holder body and with the thin rod (6) of the ruler rod mount inserted in the hole of the front projection of the holder body until the opposite projections (11) of the head of the ruler rod mount (4) are caught by the window openings of the side walls (2*a*).

2. The holder for detachably holding a presser foot according to claim 1 wherein said holder body is of a molded metal whereas said ruler rod mount is of a synthetic resin mold.

3. The holder for detachably holding a presser foot according to claim 1 wherein said holder body is of a synthetic resin whereas said ruler rod mount is of a synthetic resin which has a lower hardness than the synthetic resin of the holder body.

4. The holder for detachably holding a presser foot according to claim 1 wherein the front of said holder body has a white coating applied thereto.

* * * * *